US008482414B2

(12) United States Patent
Leyden et al.

(10) Patent No.: US 8,482,414 B2
(45) Date of Patent: Jul. 9, 2013

(54) ANTI-THEFT DEVICE FOR SPORTING GOODS

(75) Inventors: Roger J. Leyden, Inverness, IL (US); Terrance Surma, Carol Stream, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 874 days.

(21) Appl. No.: 12/589,753

(22) Filed: Oct. 27, 2009

(65) Prior Publication Data

US 2011/0095893 A1 Apr. 28, 2011

(51) Int. Cl.
*G08B 13/14* (2006.01)

(52) U.S. Cl.
USPC ..... 340/572.9; 340/572.8; 340/572.1; 340/568.1

(58) Field of Classification Search
USPC ..... 340/572.1–572.9, 571, 568.1, 573.1, 340/691.1; 215/224, 201, 211, 277, 280; 220/557.1, 790; 473/559–564
See application file for complete search history.

(56) References Cited

U.S. PATENT DOCUMENTS

| | | | | |
|---|---|---|---|---|
| 5,969,613 | A * | 10/1999 | Yeager et al. | 340/572.9 |
| 6,933,847 | B2 * | 8/2005 | Feibelman | 340/572.1 |
| 7,167,096 | B2 * | 1/2007 | Marsilio et al. | 340/572.9 |
| 7,342,495 | B2 | 3/2008 | Sayegh | |
| 7,394,376 | B1 | 7/2008 | Sayegh et al. | |
| 7,804,405 | B2 * | 9/2010 | Norman et al. | 340/572.1 |

* cited by examiner

*Primary Examiner* — Anh V La
(74) *Attorney, Agent, or Firm* — Richard D. Harris

(57) ABSTRACT

A theft-deterring security apparatus for articles with handles is described. The apparatus consists of a bracket that substantially surrounds an article handle and a locking body into which the bracket is telescopically inserted, to in turn compress both the bracket and the locking body about the article handle so as to be releasably fastened thereto. Fastening devices, such as a threaded screw and nut, are used to initiate and maintain compression of the bracket and locking body about the article handle. The bracket is shaped to accommodate different types of article handles. The bracket may be hinged to accommodate the insertion of article handles into the bracket periphery. The apparatus is further equipped with an electronic article surveillance element capable of setting off an alarm if an attempt is made to remove the article from the store. Alternatively, a pair of locking body elements surrounds a knob on an article handle. The locking body elements each include a cavity portion that combine to form cavities within which the knob of an article handle and an electronic article surveillance tag and/or a tethered anchor may be placed.

42 Claims, 8 Drawing Sheets

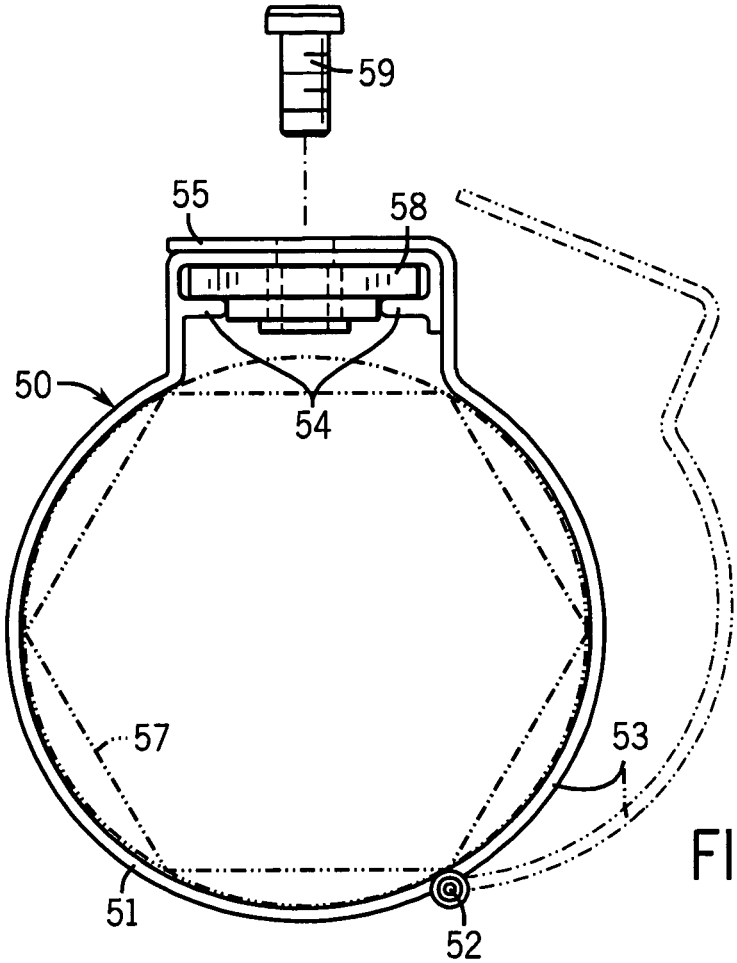
FIG. 6
FIG. 7
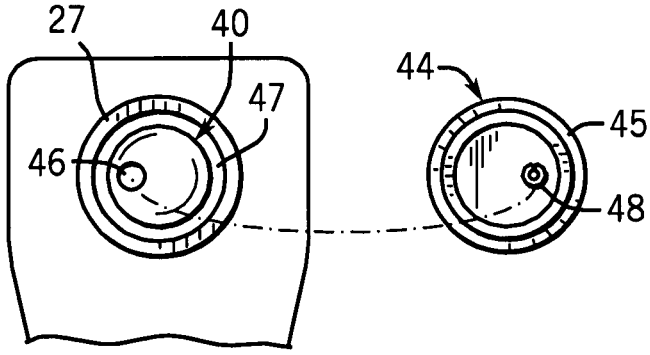

ANTI-THEFT DEVICE FOR SPORTING GOODS

BACKGROUND

Field of the Invention

The invention relates to theft deterrent devices, and in particular, to anti-theft security tags attached to articles with handles, which security tags may possess an electronic surveillance capability. Various types of electronic surveillance devices are known, many of which utilize a tag affixed to an article intended to be protected against theft through the use of an alarm system. If a thief takes the article beyond a certain area, generally at the exit of a store, an electronic detection system senses the article passing over the perimeter, often by detecting the presence of a radio-frequency identification ("RFID") tag, thus setting off the alarm and alerting store employees to the unauthorized removal of the article from the store premises. When the article is purchased, the security tags are usually removed or deactivated by store employees to ensure the legitimate customer's ability to exit the store without triggering the alarm.

Anti-theft article surveillance tags have been widely used in the clothing industry, with tags being secured to articles of clothing using pins or other means that pierce the article. This method of attaching surveillance tags to articles of clothing is desirable because it leaves no trace of the surveillance tag after a customer has made a legitimate purchase. Most importantly, the tags allow articles to be freely displayed and handled directly by customers, while preventing, or at least discouraging, thieves from removing the articles from the store without triggering an alarm.

Other retailers continue to seek ways to deter theft similar to clothiers, while still allowing customers to directly handle and/or test the merchandise. Merchandisers know that displaying their goods either in locked display cases or simply behind display counters and out of a customer's reach may decrease sales because customers often feel uncomfortable or unduly pressured to make a purchase when asking to handle or test items under the direct supervision of store employees. Indeed, merchants in the field of sporting goods merchandise, for example, must allow their customers to test the merchandise—to hold it, feel its material and weight and test its size, shape and manner of use, for example, by swinging it. Moreover, unlike the goods of clothiers, these types of merchandise cannot simply pierce the article to attach such tags. Rather, it is desirable to provide theft-deterring apparatuses that completely surround a portion of an article, attaching a tether or an electronic surveillance element thereto, while at the same time leaving such articles, once purchased, without a trace of the apparatus previously attached.

It is further desirable to create a low-cost theft-deterring apparatus that may be easily attached to the handles of several different types of articles. This universality—allowing a single apparatus to be used on different articles—is more helpful and less expensive for retailers to incorporate such devices into their businesses. Moreover, it would be beneficial to allow retailers to integrate such theft-deterring apparatuses into alarm systems that would immediately alert retailers to any attempted theft. These and other desirable characteristics of the invention will become apparent in view of the present specification, including the claims and drawings.

SUMMARY OF THE INVENTION

The present invention provides a theft-deterring security tag that can be attached to the handles of articles without leaving any trace of its previous securement. In one embodiment for articles with elongated handles, the security apparatus is comprised of a bracket and a locking body. The bracket, which surrounds portions of elongated handles, may be shaped in any number of ways to accommodate all sorts of article handles. Regardless of its overall shape, a portion of the bracket is substantially rectangular such that it may be inserted into a rectangular cavity within the locking body—thus compressing the article handle between the bracket and the locking body. This compression restrainably attaches the locking body to such an elongated handle by way of fastener elements positioned between the bracket and locking body. In one embodiment, the fastening elements are a threaded screw and a nut, but the fastening elements are not so limited. The differently-shaped brackets may be used interchangeably with the locking body, which is designed to hold—away from customer access—an RFID signaling member. The locking body telescopically receives the fitted, substantially rectangular portion of the bracket so as to compress the handle of an article between the locking body and the inside surface of the bracket.

The bracket is sized and shaped to fit around the handle of an article, and has a front end and back end. In one preferred embodiment, the bracket is in the shape of a rectangle to fit around the handle of a hockey stick, with the inside of the bracket's back end comprising one surface against which the article handle is compressed. While the bracket is shaped at its front end to be telescopically received snugly within the locking body, the rest of the bracket may be shaped, for example, substantially into a circle or a hexagon to accommodate the handles of baseball bats or tennis rackets, respectively.

In yet another embodiment, the bracket comprises a first portion, a second movable portion and a hinge between the first and second portions to enable rotation therebetween. Such a bracket is capable of accommodating articles over which a fixed, one-piece bracket cannot easily be slid. For example, baseball bats are known to have ends that are wider than the handle—the body being larger to hit a baseball with amplified force and the bottom end being larger to prevent the bat from slipping out of a player's hands. A single continuous bracket might not be used with such an article because it may not be able to fit over the article's larger end. However, a hinged bracket can be opened and the article inserted therewithin before enclosing the hinged bracket to surround the article handle. Alternatively, a bracket could be open-ended and made of resiliently sprung material such that it could be spread apart to facilitate the insertion of an article handle therewithin before the bracket returned to its natural, closed shape. In either case, once closed, a fitted portion of the front end of the bracket can be inserted and telescopically received by the locking body.

The locking body has a front side and a back side and is sized and shaped to enable the telescopic receipt of the front end of the bracket. The locking body contains at least one cavity region into which the bracket will be inserted, and, in one embodiment, contains another cavity region, in which an RFID tag or other electronic surveillance element can be affixed. In another embodiment, this second cavity region extends farther beyond the first cavity region to facilitate the placement of the electronic surveillance element farther away from article handle. This increased distance between the article handle and the electronic surveillance element helps ensure the reliability of the electronic surveillance element, which can be detrimentally affected by article handles which contain metal. In either embodiment, the top and bottom sides of the cavity region(s) correspond to the back side of the locking body. The top and bottom sides of the cavity region(s)

form at least a portion of a bearing periphery that comes into direct contact with the article handle, serving to assist in compressing the article handle against the inside surface of the back end of the bracket.

The fastening elements aid in creating and maintaining compression of the apparatus on the article handle between the locking body and the inside back end of the bracket. In a preferred embodiment, the fastening elements are comprised of a threaded screw and flange nut, with the head of the screw being atypical such that the average shopper cannot readily defasten the screw and remove it. While a typical slotted or Phillips-head screw could be easily removed by a shopper, thus frustrating the purpose of the theft-deterring security device, the subject fastening elements are preferably of a type that is not utilized by the general public. Moreover, the aperture on the locking body is at least partially countersunk, such that the head of the screw is partially obscured by a protruding ridge. This ridge prevents a shopper from attempting to remove the screw head-on using pliers or, from the side, by inserting a tool beneath the head of the screw to in turn use leverage to sever or pry off the heads of and/or otherwise extract the screw.

The use of multiple pieces to comprise this embodiment of theft-deterring security tags—brackets and locking bodies—allows retailers to use such security tags on nearly any article with an elongated handle. A retailer can use one of many brackets pre-formed to specifically fit numerous standardized articles, such as the handles of hockey sticks, baseball bats, tennis rackets, golf clubs and the like. Moreover, retailers can order brackets to suit any other type of article with elongated handles like umbrellas, oars, hand tools, paintbrushes and other like products.

In a preferred embodiment of the invention, a rectangular bracket is shaped to fit around the handle of a hockey stick, with a compressible friction pad being affixed to the inside of the bracket's back end. The front end of the bracket includes an aperture and flanges, the flanges intended to maintain the position of a threaded flange nut. An aperture is also located in the front side of the locking body, opposite the locking body's cavity region into which the bracket will be inserted. Thus, with the bracket surrounding the handle of a hockey stick, the bracket's front end is placed into that cavity region. A threaded screw can then be inserted through the aperture in the locking body's front side, and then inserted through the aperture in the bracket's front end, before being threaded through the aligned, mated-thread flange nut located on the inside surface of the bracket's front end. Tightening this screw would thereby compress the bearing periphery on the locking body's back side against the handle, which in turn would be compressed against the friction pad on the inside surface of the bracket's back end. Somewhere within the locking body, preferably in a second cavity region, an RFID surveillance element is included, which element would trigger an alarm upon the hockey stick's removal from a preset perimeter.

Another embodiment of the theft-deterring security apparatus is intended for articles with knobbed handles and essentially comprises two locking body elements, which—when aligned—form a locking body in a substantially frusto-conical shape. Upon articulation, the two locking body elements combine to define a first cavity, which surrounds and encapsulates the knob of the article handle. The articulated locking body also contains fastening elements that secure the locking body elements around the knob, and a second anti-theft cavity. This second cavity may contain a theft-deterring RFID tag or an anchor connected to a tether wire attached at its opposite end to a stationary object within the store (such as a wall) so that the article with a knobbed handle cannot physically be moved from its location beyond the length of the tether wire. While the anti-theft cavity originates at the knob cavity in one embodiment, forming two connected cavities, the anti-theft cavity in an alternative embodiment is separate and distinct from the knob cavity to facilitate the placement of the electronic surveillance element farther away from knobbed handle. Again, this increased distance between the knobbed handle and the electronic surveillance element helps ensure the reliability of the electronic surveillance element, which can be detrimentally affected by article handles which contain metal.

In this embodiment, as well as those above, the RFID signaling member would itself trigger an alarm should any attempt be made to remove the article from the store without first removing the theft-deterrent apparatus—here, from the knob of the handle. Alternatively, a tether may comprise a pair of electronic conducting wires to integrate the theft-deterrent apparatus into a product or display alarm system. This second, tether option thus physically restrains the security apparatus-equipped article to further prevent theft.

The fastening elements aid in restrainably fastening the locking body elements about the knob enclosed within the two locking body elements. In a preferred embodiment, the fastening elements are comprised of two threaded screws and threaded regions within each locking body element. Each locking body element is pre-formed to include a built-in threaded region ready to engage a like-threaded screw. The threaded regions are arranged on opposite sides of each locking body element, with a corresponding aperture for each threaded region located on the opposing locking body element. When the locking body elements are aligned—forming a single locking body, a threaded screw may be inserted into the aperture in each locking body element and threaded through the threaded region built into the opposing locking body element.

As before, the head of the screws should be atypical such that the average shopper cannot readily defasten the screws and remove them. While a typical slotted or Phillips-head screw could be easily removed by a shopper, thus frustrating the purpose of the theft-deterring security device, the subject fastening elements are preferably of a type that is not utilized by the general public. Moreover, as before, the apertures on either side of the locking body are countersunk such that the head of each screw is partially obscured by a protruding ridge, which prevents a shopper from attempting to remove each screw head-on using pliers or, from the side, by inserting a tool beneath the head of the screw to in turn use leverage to sever or pry off the heads of and/or otherwise extract the screws.

In a preferred embodiment of the invention intended for baseball bats, two substantially identical locking body elements each contain two cavity portions, and each comprises one-half—a cross-section—of a frusto-conical shape. The knob of the baseball bat fits partially within the first cavity portion in one locking body element and the first cavity portion on the other locking body element may be placed thereon, thus enclosing the knob within the first cavity—the knob cavity—formed by the articulated locking body. On the end of each locking body element opposite the first cavity portion lies a threaded region on one side, an aperture for a threaded screw on the other side and a second cavity portion, which second cavity portions align to form a second anti-theft cavity when the locking body elements are articulated together around the knob. Once both locking body elements are aligned about the knob of the baseball bat, a screw must be inserted in the aperture of each locking body element and threaded through the built-in threaded region located on the opposing locking body element. As the screws tighten, the locking body elements are contracted into one another to form the articulated locking body, in which the anti-theft cavity contains a theft-deterring element. In one embodiment, the theft-deterring element is an electronic surveillance element such as an RFID tag, which element would trigger an alarm upon the baseball bat's removal from a preset perimeter. In another embodiment, an anchor attached to a tether wire is placed within the anti-theft cavity before the locking body elements are fastened around the knob by way of the screws and threaded regions. The tether wire, which protrudes through an aperture on the surface of the articulated locking body, can be attached to a counter, display, bracket or wall, or some other stationary object, to impede the bat's removal beyond a certain distance.

BRIEF DESCRIPTION OF THE DRAWINGS

FIG. 6 is a top view of another embodiment of the bracket, in which the bracket is hinged, enabling it to open, receive an article handle therein, and close, and in which the bracket is shaped like a circle to accommodate articles with handles shaped substantially cylindrically.

FIG. 7 is a top view of one embodiment of a screw head with accompanying keyed tool.

DETAILED DESCRIPTION

Reference will now be made in detail to the preferred embodiments of the invention, examples of which are illustrated in the accompanying drawings. While the invention will be described in conjunction with the preferred embodiments, the invention is intended to cover alternatives, modifications and equivalents, which may be included within the spirit and scope of the invention as defined by the claims. Furthermore, in the detailed description of the present invention, several specific details are set forth in order to provide a thorough understanding of the present invention. However, one of ordinary skill in the art would appreciate that the present invention may be practiced without all of these specific details. Thus, while the invention is susceptible to embodiment in many different forms, the subsequent description of the present disclosure should be considered only as an exemplification of the principles of the invention, one that is in no way intended to limit the invention to the embodiments so illustrated.

Figure 1A:
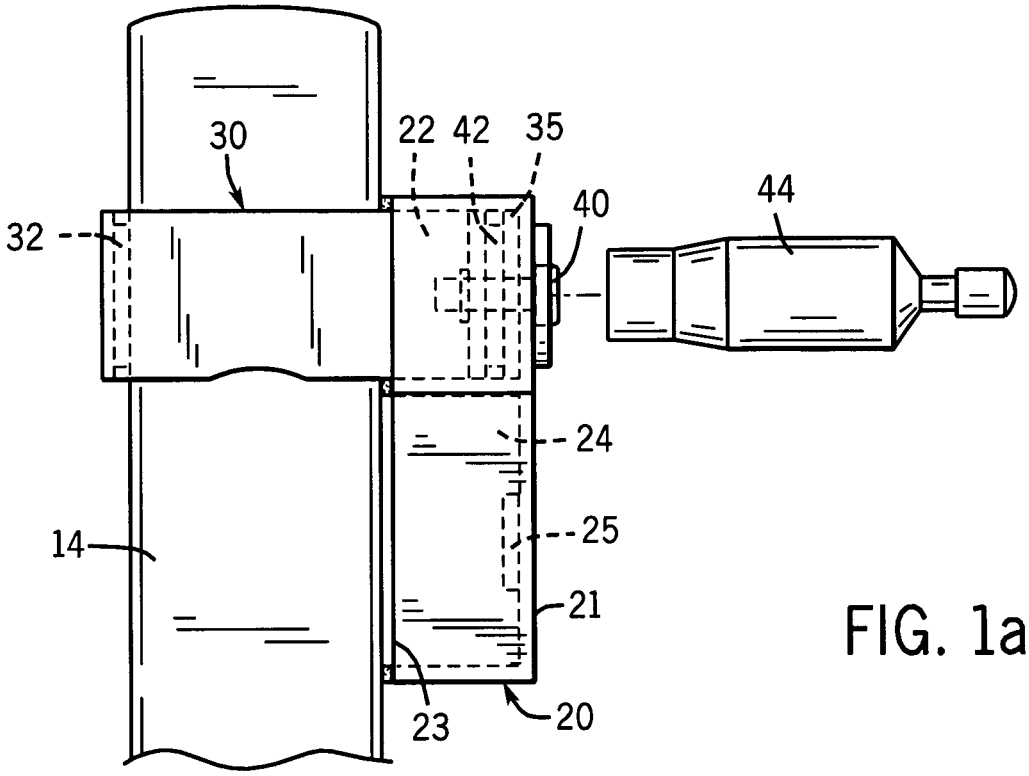
FIG. 1*a* is an elevated side view of a bracket and locking body restrainably positioned about the elongated handle of an article, such as a hockey stick, in which the keyed tool for the fastening element is shown in exploded fashion.
Figure 1B:
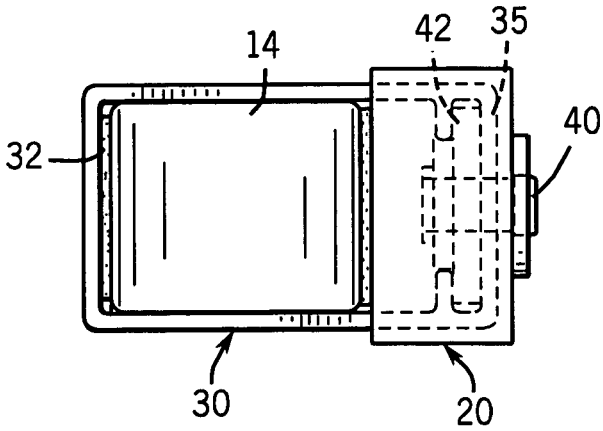
FIG. 1*b* is an elevated top view of a bracket and locking body restrainably positioned about the elongated handle of an article, such as a hockey stick.

FIGS. 1*a* and 1*b* show views (side and top, respectively) of a complete preferred embodiment of the invention, in which the invention is secured around rectangular article handle 14, such as the handle of a hockey stick. Rectangular article handle 14 is substantially surrounded by bracket 30, with rectangular article handle 14 being compressed against compressible friction pad 32 affixed to the back end of bracket 30. When bracket 30 is inserted into top cavity 22 at back side 23 of locking body 20, top cavity 22 of locking body 20 fits over and around the front end 35 of bracket 30, as seen in FIG. 5*b*. A bearing periphery—28*a*, 28*b* and 28*c*, collectively, as shown in FIG. 3*b*—is positioned on back side 23 of locking body 20, and compresses rectangular article handle 14 against compressible friction pad 32 when screw 40 is tightened into flange nut 42 using screw driving element 44. Bottom cavity 24, as shown in FIG. 3*b*, of locking body 20, preferably contains an electronic surveillance element 25, such as an RFID tag, which is capable of setting off an alarm when the article is carried beyond a preset perimeter.

Figure 2:
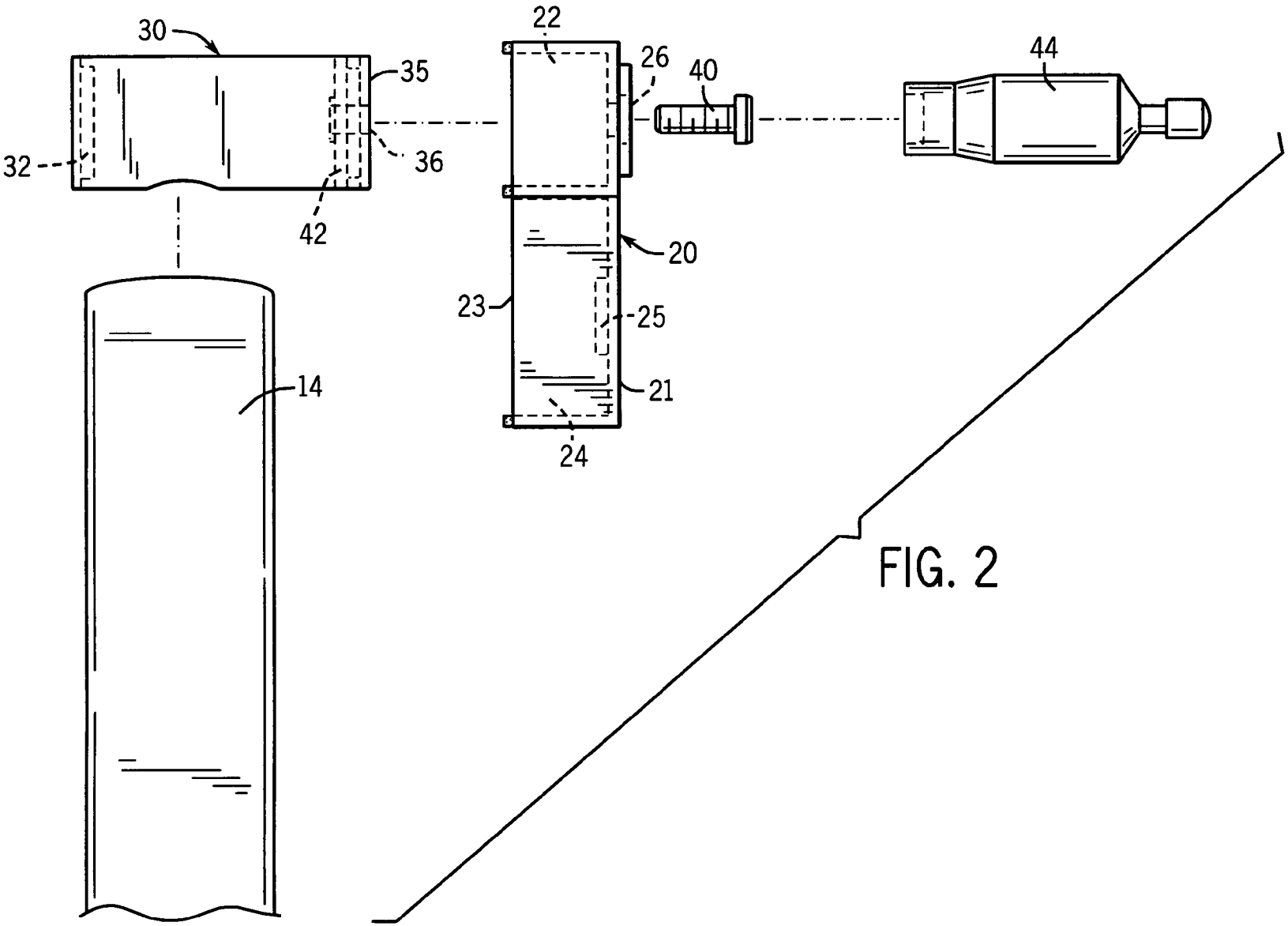
FIG. 2 is an exploded, elevated side view of an elongated article handle, such as a hockey stick, a bracket, a locking body and fastening elements, including a threaded screw and flange nut (shown within the front end of the bracket) and the keyed tool used to operate the atypical screw.

In FIG. 2, a preferred embodiment of the invention is shown in exploded view, which enables a description of all of the invention's components for securement thereof to rectangular article handle 14. At least a portion of rectangular article handle 14 is inserted up through and into bracket 30. Front end 35 of bracket 30 can then be inserted into top cavity 22 at back side 23 of locking body 20. Bottom cavity 24 contains electronic surveillance element 25 capable of setting off an alarm when the article is carried beyond a preset perimeter.

Then, threaded fastener screw 40 is inserted into aperture 26 on front side 21 of locking body 20, which screw 40 continues through aperture 36 in front end 35 of bracket 30 to engage like-threaded fastener flange nut 42. Screw 40 and flange nut 42 can be tightened using screw driving element 44. As screw 40 is tightened, top cavity 22 of locking body 20 telescopically receives front end 35 of bracket 30, such that the bearing periphery 28*a-c* on back side 23 of locking body 20, shown in FIG. 3*b*, compresses rectangular article handle 14 against compressible friction pad 32 fitted on the back end of bracket 30. With rectangular article handle 14 being compressed between back side 23 of locking body 20 and compressible friction pad 32 at the back end of bracket 30, electronic surveillance element 25 is contained within bottom cavity 24 on the inside surface of front side 21 of locking body 20, making it substantially inaccessible to customers to in turn prevent its removal therefrom. The overall length of locking body 20 from front side 21 to back side 23—in combination with the length of screw 40—ensure that screw 40 avoids contact with handle article 14.

Figure 3A:
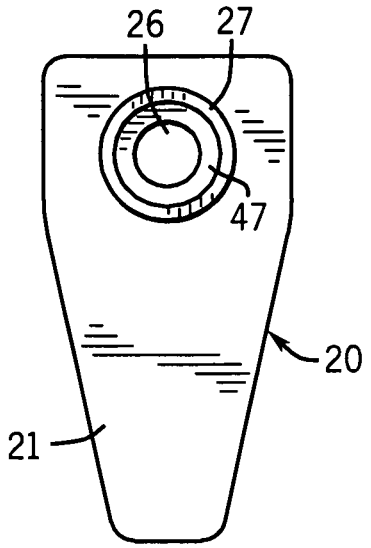
FIG. 3*a* is an elevated view of the front side of one embodiment of the locking body.
Figure 3B:
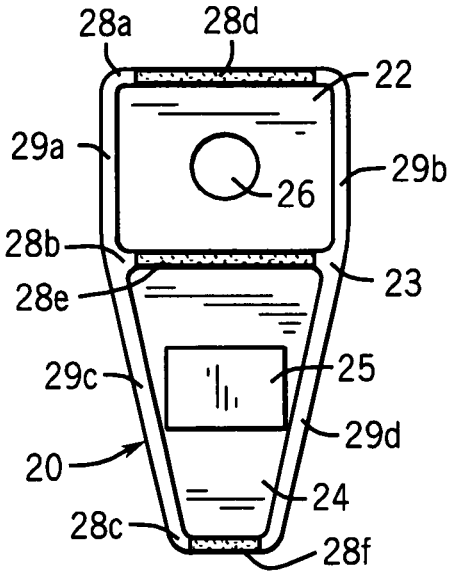
FIG. 3*b* is an elevated view of the back side of one embodiment of the locking body.

Front side 21 of a preferred embodiment of locking body 20 is shown in elevated view in FIG. 3*a*. Front side 21 of locking body 20 contains aperture 26 through which screw 40, as shown in FIG. 2, may be inserted. Aperture 26 is surrounded by annular ridge 27, which—as seen in FIG. 7—facilitates the fastening and defastening of screw 40 by screw driving element 44. The head of screw driving element—seen in FIG. 7—contains annular ridge 45 that fits snugly around the head of screw 40 and snugly within annular ridge 27, resting within annular groove 47. As FIGS. 3*a* and 7 show, annular ridge 27 protrudes away from aperture 26 such that the former partially obscures the head of screw 40. Annular ridge 27 thus prevents a shopper from attempting to remove screw 40 head-on using pliers or, from the side, by inserting a tool beneath the head of screw 40 to in turn use leverage to sever or pry off the heads of and/or otherwise extract screw 40.

Back side 23 of a preferred embodiment of locking body 20 is shown in elevated view in FIG. 3*b*. Top cavity 22 of locking body 20 includes aperture 26, which aligns with aperture 36 on front end 35 of bracket 30, shown in FIG. 5*b*, when front end 35 is inserted into top cavity 22 of locking body 20. Bottom cavity 24 of locking body 20 contains electronic surveillance element 25, again, capable of setting off an alarm when the article is carried beyond a preset perimeter.

As FIG. 3*b* shows, top cavity 22 of locking body 20 is formed by top side 28*a*, left side 29*a*, right side 29*b* and bottom side 28*b*, which bottom side 28*b* corresponds to the top side of bottom cavity 24 of locking body 20—making side 28*b* the shared side between top cavity 22 and bottom cavity 24. Bottom cavity 24 is thus formed by its top side—shared side 28*b*, bottom side 28*c*, left side 29*c* and right side 29*d*. The distance between left and right sides 29*a-b* of top cavity 22 is barely greater than the length of the front end 35 of bracket 30, and the distance between top side 28*a* and shared side 28*b* is barely greater than the height of the front end 35 of bracket 30, shown in FIG. 5*b*. Thus, the front end 35 of bracket 30 fits snugly within top cavity 22 of locking body 20. Sides 27*c-d* isolate the position of electronic surveillance element 25 to render it inaccessible to customers. When back side 23 of locking body 20 is compressed against rectangular article handle 14, as in FIG. 1*a*, top side 28*a*, shared side 28*b* and bottom side 28*c* form the bearing periphery 28*a-c* on back side 23 of locking body 20, making contact with rectangular article handle 14 and compressing it against the inside back end of bracket 30, at which location the compressible friction pad 32 is affixed, as shown in FIGS. 1*a* and 1*b*. Thus, compressible friction pads 28*d*, 28*e* and 28*f* may be fitted to horizontal bearing periphery 28*a*, 28*b* and 28*c*, respectively, to ensure that all surfaces that bear against rectangular article handle 14 protect rectangular article handle 14 from being scratched or scuffed.

Figure 4:
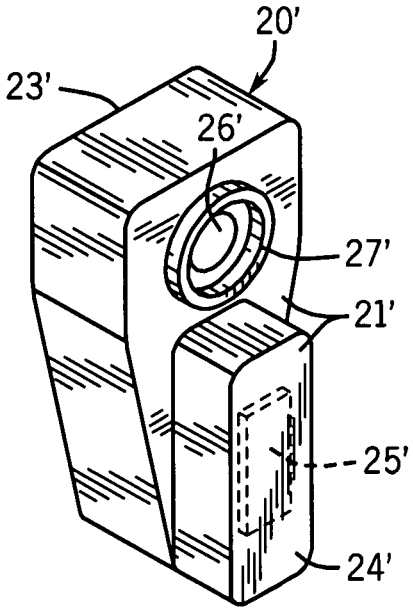
FIG. 4 is a perspective view of an alternative embodiment of the locking body.

An alternative embodiment of locking body 20' with deeper bottom cavity 24' is shown in perspective view in FIG. 4. In comparison with the other embodiment, front side 21' here of the bottom portion of locking body 20' is farther away from back side 23' to create deeper bottom cavity 24'. The increased depth of deeper bottom cavity 24' facilitates the placement of electronic surveillance element 25' farther away from article handle 14 when same is secured with locking body 20' as demonstrated in FIG. 1*a*. The increased distance ensures the functionality of electronic surveillance element 25' in cases where article handle 14 contains metal, which can detrimentally affect the reliability of electronic surveillance element 25'.

Figure 5A:
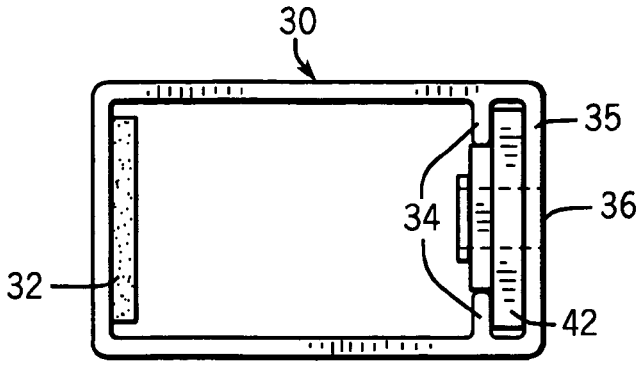
FIG. 5*a* is a top view of a preferred embodiment of the bracket.
Figure 5B:
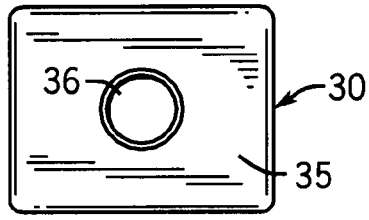
FIG. 5*b* is an elevated view of the front end of a preferred embodiment of the bracket.

A top view of a preferred embodiment of bracket 30 is seen in FIG. 5*a*. On the left—the back end—bracket 30 is fitted with compressible friction pad 32, against which rectangular article handle 14 is compressed, as in FIG. 1*a*. On the right, near front end 35, two flanges 34 hold flange nut 42 in place to ensure its proper receipt of screw 40, as shown in FIG. 2. Aperture 36 on front end 35 of bracket 30 is visible in dotted lines through both front end 35 and flange nut 42.

FIG. 5*b* shows a view of front end 35 of a preferred embodiment of bracket 30. Aperture 36 in front end 35 of bracket 30 aligns with aperture 26 in top cavity 22 of locking body 20, seen in FIG. 3*b*, so that screw 40 can be inserted through both apertures 26 and 36, as shown in FIG. 2.

Figure 5C:
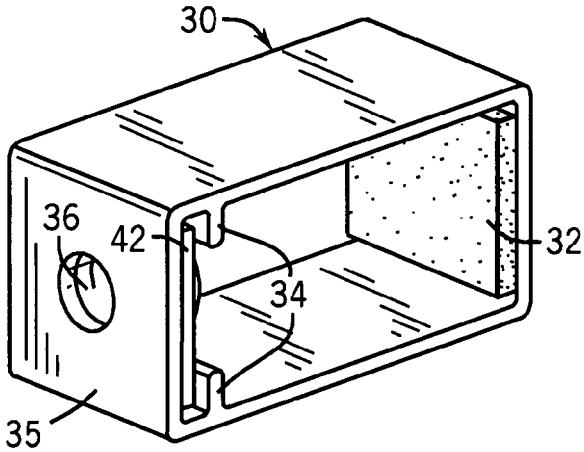
FIG. 5*c* is a perspective view from the front end of a preferred embodiment of the bracket.

A perspective view of bracket 30 sitting on its side and viewed from front end 35 is seen in FIG. 5*c*. Front end 35 contains aperture 36, through which screw 40 will be inserted, while the back end is fitted with compressible friction pad 32, against which rectangular article handle 14 is compressed by bearing periphery 28*a-c* on back side 23 of locking body 20, as demonstrated in FIG. 2. Flanges 34 protrude from the sides of bracket 30, so as to maintain the position of flange nut 42 for alignment and threaded engagement with screw 40.

Figure 5D:
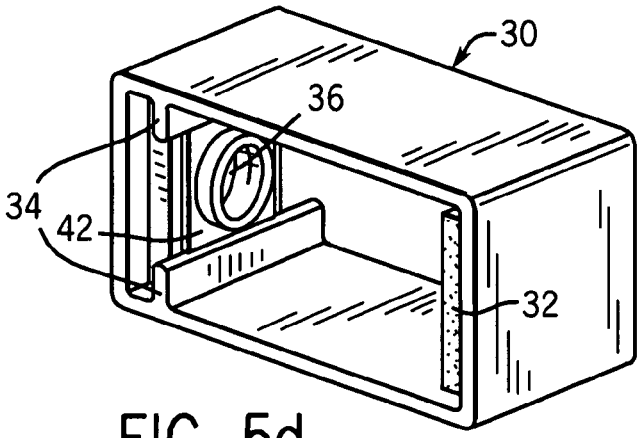
FIG. 5*d* is a perspective view from the back end of a preferred embodiment of the bracket.

FIG. 5*d* shows a perspective view from the back end of bracket 30, sitting on its side. Aperture 36 in the front side 35 is seen through the hole of flange nut 42, which is held in position by flanges 34. On the right, compressible friction pad 32 is fitted to the back end of bracket 30 to facilitate the maintained position of rectangular article handle 14, as shown in FIG. 1*b*.

An alternative embodiment of bracket—bracket 50—is seen in FIG. 6. As shown, bracket 50, being in the shape of a circle, accommodates articles with handles shaped substantially cylindrically. However, as the phantom lines of periphery 57 make clear, bracket 50 may also take the shape of a hexagon, thus accommodating articles with handles shaped substantially hexagonally. Notably, bracket 50 can be used with locking body 20 because, regardless of the shape of bracket 50, front end 55 of bracket 50 is rectangular and sized to fit snugly within top cavity 22 of locking body 20, as seen in FIG. 3*b*. Like rectangular bracket 30, shown in FIG. 5*a*, bracket 50 uses flanges 54 to hold flange nut 58 in place, to enable its receipt of screw 59 upon the insertion of front end 55 of bracket 50 into the top cavity 22 of locking body 20.

FIG. 6 also demonstrates how alternative bracket 50 may be designed to accommodate article handles with ends wider than their bodies (such as baseball bats—see above paragraph 7). In one embodiment, bracket 50 is formed of a resilient, spring-loaded material and is operably rotatable around pivot point 52. Alternatively, bracket 50 is comprised of first portion 51, second, movable portion 53 and hinge 52 operably connecting first portion 51 and second, movable portion 53. In the first case, pivot point 52 facilitates the spreading of bracket 50 to enable the placement of an article handle (not pictured) therewithin. Then, bracket 50 may be collapsed around the article handle (not pictured), with the end of second portion 53 overlapping the opposite end of first portion 51, such that rectangular front end 55 of bracket 50 may be inserted into top cavity 22 of locking body 20. In the second case, hinge 52 facilitates the rotation of second, movable portion 53 to enable the opening of bracket 50 and placement therewithin of an article handle (not pictured). The second portion 53 can then swing shut, with the end of second portion 53 overlapping the opposite end of first portion such that rectangular front end 55 of bracket 50 may be inserted into top cavity 22 of locking body 20. Thus, as FIG. 6 makes clear, a bracket could be any number of shapes and/or comprised of movable portions or a resilient, spring-loaded material to accommodate all types of article handles.

FIG. 7 shows a top view of one embodiment of screw driving element 44 with accompanying screw 40. While the fastening elements that compress locking body 20 to bracket 30 (or bracket 50) are by no means limited, the fastening elements here are threaded screw 40 and mated threaded flange nut 42. Screw 40, however, preferably avoids a typical, widely available, screw head to prevent any customer with the appropriate common screwdriver from unfastening the screw and removing the security apparatus. As such, atypical screw heads—such as the one shown in FIG. 7—are contemplated. Threaded screw 40 has a smooth, planar head except for a cylindrically-shaped hole 46. Screw driving element 44 has a corresponding operating element 48—a cylindrical protrusion—capable of being inserted into hole 46 in the head of screw 40 to turn screw 40. As previously noted, annular ridge 27 facilitates the fastening and defastening of screw 40 by screw driving element 44. Annular ridge 45 on the head of screw driving element 44 fits snugly around the head of screw 40 and snugly within annular ridge 27, resting within annular groove 47. While a screw head is shown in FIG. 7 as an example of an atypical mechanism for turning the screw, it should be appreciated that the invention is not limited in this respect, and can be used with any screw 40 that contains an atypical operating mechanism, to ensure that customers cannot remove the security apparatus from the handles of articles with commonplace phillips, alien, and/or slotted screwdrivers.

Figure 8:
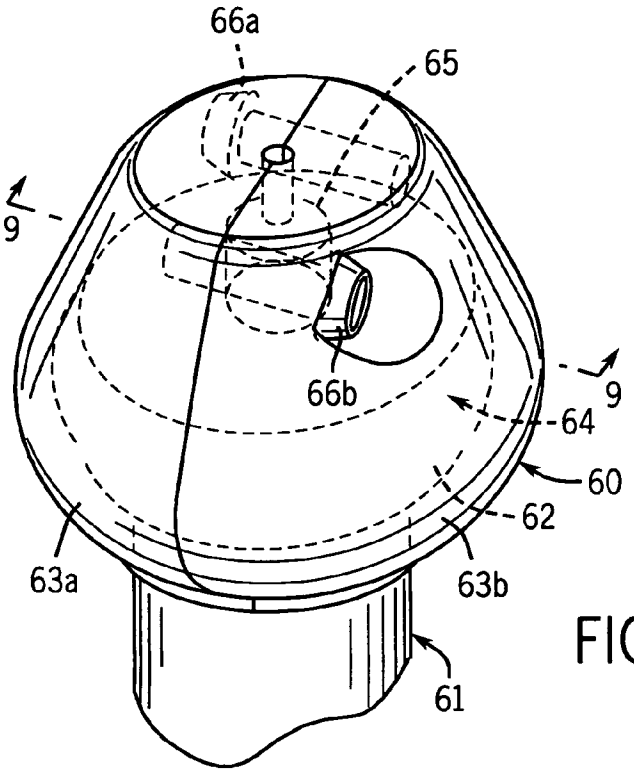
FIG. 8 is a perspective view of an alternative embodiment of the invention intended for knobbed handles, showing the two locking body elements articulated into a single locking body attached to the knob of a baseball bat.

An alternative embodiment of locking body 60, intended for articles with knobbed or specially shaped handles, is shown in FIG. 8 surrounding knob 62 of baseball bat 61. Locking body elements 63*a* and 63*b* articulate together to form locking body 60, which is sized and shaped to fit around knob 62. When locking body 60 is articulated, first cavity portions 64*a* and 64*b*, seen in FIG. 10, combine to form knob cavity 64, which surrounds knob 62, while second cavity portions 65*a* and 65*b*, also seen in FIG. 10, combine to form anti-theft cavity 65. Locking body elements 63*a* and 63*b* are joined together using threaded screws 66*a* and 66*b* and threaded regions 68*a* and 68*b*, shown in FIG. 10. As in the embodiments above, threaded screws 66*a* and 66*b* are positioned such that the head of each screw 66*a* and 66*b* is at least partially obscured by a protruding ridge extending outward from apertures 67*a* and 67*b*, seen in FIG. 10. As previously discussed, the protruding ridge prevents a typical shopper from attempting to remove screws 66*a* and 66*b*—either head-on using pliers or, from the side, by inserting a tool beneath the head of screws 66*a* and 66*b* in an attempt to sever or pry off the heads of and/or otherwise extract same.

Figure 9:
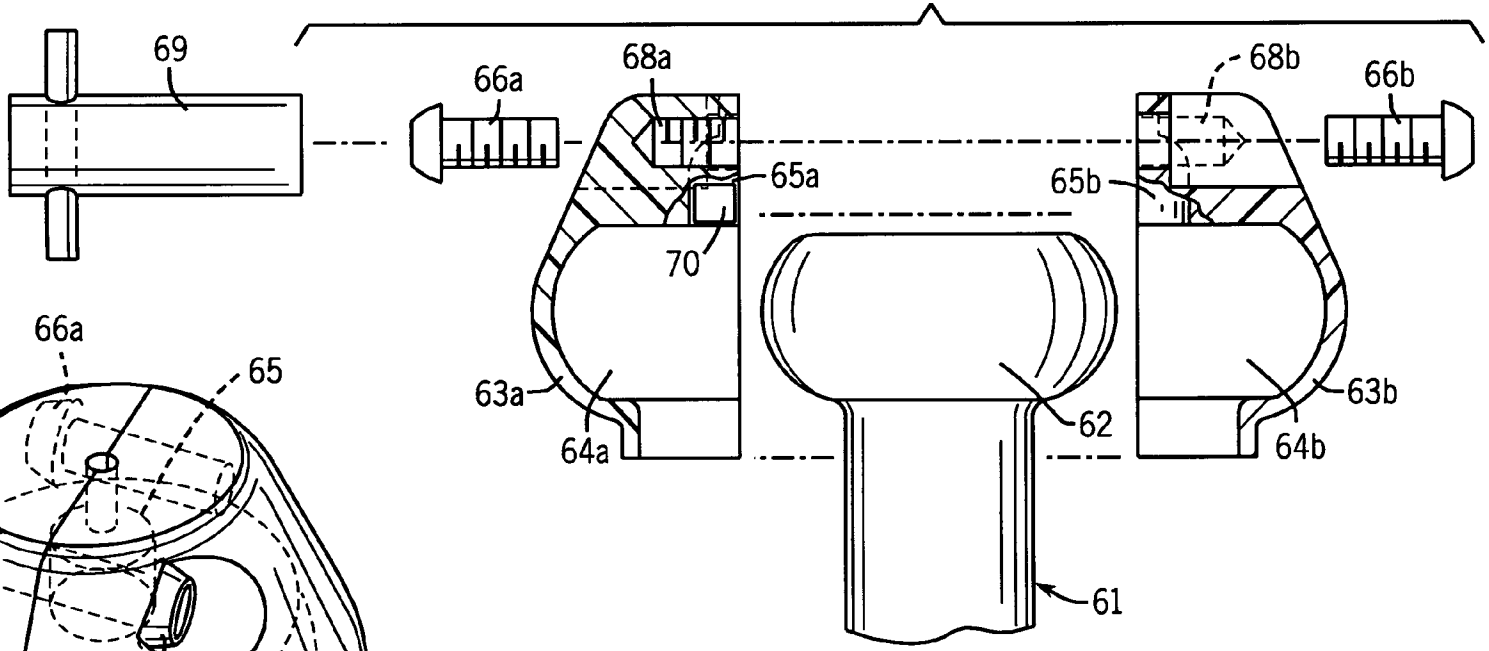
FIG. 9 is an exploded view—partially in cross-section, taken along line 9-9 of FIG. 8 and looking in the direction of the arrows—of the alternative embodiment of the invention of FIG. 8 intended for knobbed handles, in which the invention is seen oriented about the knob of a baseball bat, showing two locking body elements on either side of the knob, along with the screws and keyed tool used to secure the screws within each locking body element.

An exploded view of locking body 60—shown in partial cross-section, taken from line 9-9 of FIG. 8 and looking in the direction of the arrows—is seen in FIG. 9 around knob 62 of baseball bat 61. Locking body elements 63*a* and 63*b* are held with first cavity portions 64*a* and 64*b* on opposite sides of knob 62. Locking body elements 63*a* and 63*b* are then restrainably fastened to one another, with first cavity portions 64*a* and 64*b* combining to form knob cavity 64, which surrounds knob 62, as shown in FIG. 8. This orientation is achieved when threaded screws 66*a* and 66*b* are tightened through threaded regions 68*b* and 68*a*, respectively. Screw driving element 69 is used to operate and turn threaded screws 66*a* and 66*b*. Threaded screws 66*a* and 66*b* preferably avoid a typical, widely available, screw head to prevent any customer with the appropriate common screwdriver from unfastening the screw and removing the security apparatus. As such, atypical screw heads—such as the one shown in FIG. 7—are contemplated.

Figure 10:
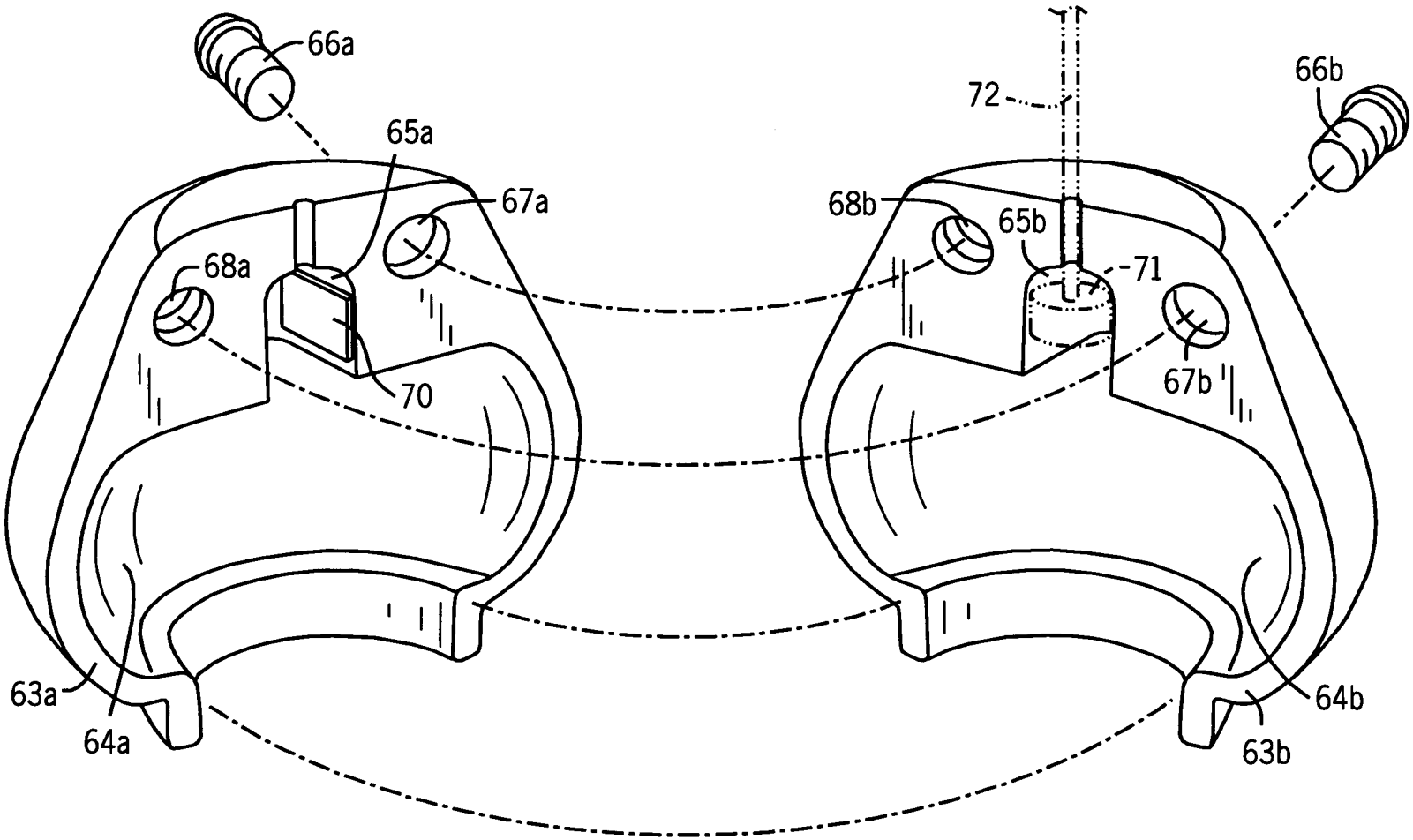
FIG. 10 is an exploded, rotated perspective view of the two unsecured locking body elements of the embodiment of the invention intended for knobbed handles of FIG. 8, showing the screws, apertures and threaded regions comprising the fastener elements, as well as an anchor and tether wire and an RFID tag.

FIG. 10 is an exploded, rotated perspective view showing how locking body elements 63*a* and 63*b* join together to restrainably fasten about knob 62 of baseball bat 61, as seen in FIG. 9. Locking body elements 63*a* and 63*b*, as shown herein, may be substantially identical: each locking body element includes (1) an aperture 67*a* (or 67*b*) on one side, (2) a threaded region 68*a* (or 68*b*) on the other side, (3) a first cavity portion 64*a* (or 64*b*) and (4) a second cavity portion 65*a* (or 65*b*), which cavity portions align with one another in an articulated locking body to form knob cavity 64 and anti-theft cavity 65, seen in FIG. 8. Thus, with cavity portions 64*a* and 64*b* combining to form knob cavity 64 and cavity portions 65*a* and 65*b* combining to form anti-theft cavity 65, FIG. 10 demonstrates the location of theft-deterring elements contained within locking body 60. In one embodiment, anti-theft cavity 65 contains electronic article surveillance element 70, such as an RFID tag, which is capable of setting off an alarm when baseball bat 60 is carried beyond a preset perimeter. Alternatively, anti-theft cavity 65 may contain anchor 71 affixed to an aircraft-grade tether wire 72, the opposite end of which may be affixed to a stationary object within the store (not shown), thus impeding the removal of baseball bat 61 beyond the perimeter defined by the length of tether wire 72. Alternatively, tether wire 72 may contain two electricity-conducting wires (not shown) that would enable the use of an alarm system, whereby the severing of tether wire 72 would sound an alarm alerting store employees to potential theft.

FIG. 10 also shows how threaded screws 66*a* and 66*b* are used to restrainably fasten locking body 60 into its fully enclosed position around knob 62 of baseball bat 61. Threaded screw 66*a* is inserted through aperture 67*a* in locking body element 63*a* before it is inserted into and threaded through threaded region 68*b* of locking body element 63*b*. Likewise, threaded screw 66*b* is inserted through aperture 67*b* in locking body element 63*b* before it is inserted into and threaded through threaded region 68*a* of locking body element 63*a*. Thus, locking body 60 is only fully restrainably fastened when threaded screws 66*a* and 66*b* are tightened and threaded fully through threaded regions 68*b* and 68*a*, respectively. As noted above, apertures 67*a* and 67*b* are each deep enough to partially obscure threaded screws 66*a* and 66*b* when locking body elements 63*a* and 63*b* are articulated together, such that the heads of screws 66*a* and 66*b* are inaccessible except when operated by screw driving element 69, as seen in FIG. 9. Again, this partial obscuring of screws 66*a* and 66*b* frustrates attempts by customers to insert a tool beneath the head of screws 66*a* and 66*b* in an attempt to sever or pry off the heads of and/or otherwise extract screws 66*a* and 66*b*.

Figure 11:
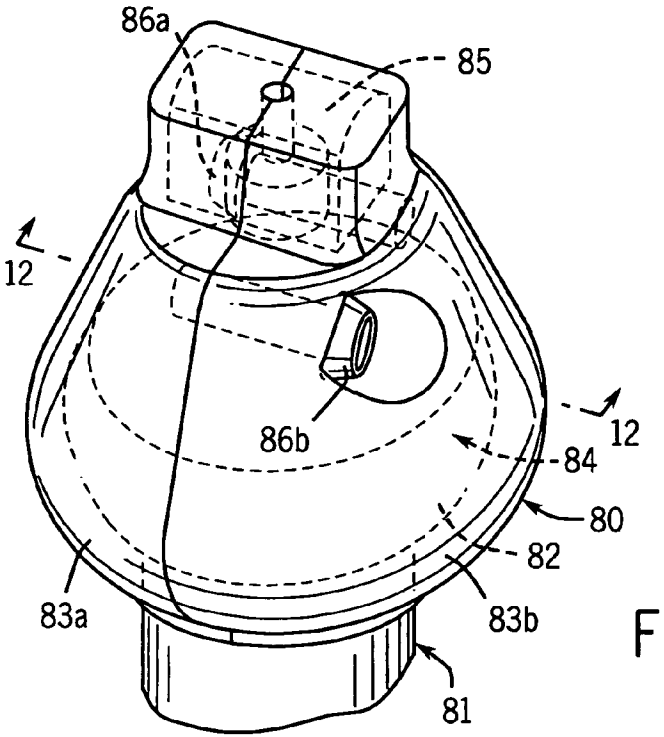
FIG. 11 is a perspective view of an alternative embodiment of the invention intended for knobbed handles, showing the two locking body elements articulated into a single locking body attached to the knob of a baseball bat, in which the anti-theft cavity is separated from the knob cavity, thus ensuring the reliability of an electronic surveillance element.

An alternative embodiment of locking body 60—locking body 80—is also intended for articles with knobbed or specially shaped handles, and is shown attached to knob 82 of baseball bat 81 in FIG. 11. As in FIGS. 8 and 9, when locking body 80 is articulated, first cavity portions 84*a* and 84*b* combine to form knob cavity 84, which surrounds knob 82, while second cavity portions 85*a* and 85*b* combine to form anti-theft cavity 85. However, compared to anti-theft cavity 65, seen in FIG. 8, anti-theft cavity 85 is positioned farther from knob 82 to facilitate the placement of electronic surveillance (RFID) element 90 at a greater distance from knob 81 when locking body 80 is secured. This increased distance ensures the functionality of electronic surveillance element 90 in cases where baseball bat 81 contains metal, which can detrimentally affect the reliability of electronic surveillance element 90. Locking body elements 83*a* and 83*b* are joined together using threaded screws 86*a* and 86*b* and threaded regions 88*a* and 88*b*, shown in FIG. 12. Threaded screws 86*a* and 86*b* are positioned such that the head of each screw 86*a* and 86*b* is at least partially obscured by a protruding ridge, similar to apertures 67*a* and 67*b* in FIG. 10, so as to prevent prying of the heads of screws 86*a* and 86*b*.

Figure 12:
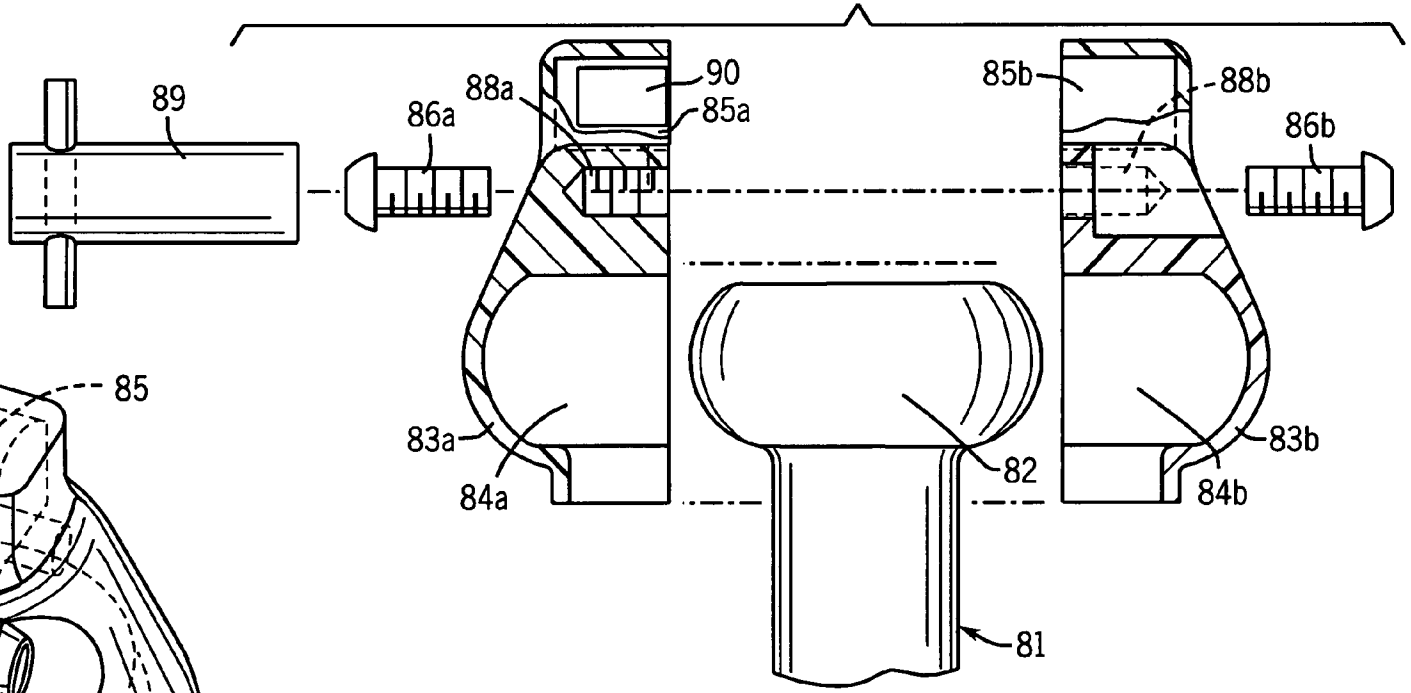
FIG. 12 is an exploded view—partially in cross-section, taken along line 12-12 of FIG. 11 and looking in the direction of the arrows—of the alternative embodiment of the invention of FIG. 11 intended for knobbed handles with a separated anti-theft cavity, in which the invention is seen oriented about the knob of a baseball bat, showing two locking body elements on either side of the knob, along with the screws and keyed tool used to secure the screws within each locking body element.

An exploded view of locking body 80—shown in partial cross-section, taken from line 12-12 of FIG. 11 and looking in the direction of the arrows—is seen in FIG. 12 around knob 82 of baseball bat 81. In FIG. 12, locking body elements 83*a* and 83*b* are oriented about first cavity portions 84*a* and 84*b* on opposite sides of knob 82. Locking body elements 83*a* and 83*b* are then restrainably fastened to one another, with first cavity portions 84*a* and 84*b* combining to form knob cavity 84 and second cavity portions 85*a* and 85*b* combining to form anti-theft cavity 85. Anti-theft cavity 85 is separate and positioned at a greater distance from knob cavity 84 such that anti-theft cavity 85 facilitates the placement of electronic surveillance element 90 in a position farther from knob 8 when it is secured with locking body 80, again to ensure the reliability of electronic surveillance element 90. The articulation is achieved when threaded screws 86*a* and 86*b* are tightened through threaded regions 88*b* and 88*a*, respectively. As shown in FIG. 12, screw driving element 89 is used to operate and turn threaded screws 86*a* and 86*b*. Threaded screws 86*a* and 86*b* preferably avoid a typical, widely available, screw head to prevent a customer with a common screwdriver from unfastening the screw and removing the security apparatus. As such, atypical screw heads—such as the one shown in FIG. 7—are contemplated.

What is claimed is:

1. A theft-deterring security apparatus for restraining articles with elongated handles, said apparatus comprising:

a substantially rigid, pre-shaped bracket that substantially surrounds the handle of an article so as to contain a portion of said article handle entirely therewithin;

said bracket having a front end and a back end, said front end being attached to said back end by at least one side member, between which front and back ends said portion of said article handle is releasably positioned, a locking body having a front side and a back side;

said locking body including a first cavity region positioned between said front side and said back side, said first cavity region originating at a bearing periphery along said back side, said locking body being capable of alternatively telescopically receiving at least a portion of each of said bracket's front end and said at least one side member within said first cavity region so as to compress said portion of the article handle between at least a portion of said back end of said bracket and at least a portion of the bearing periphery of said locking body, and telescopically retracting said portion of each of said bracket's front end and said at least one side member, to in turn release from said compression said portion of said article handle within said bracket, and alignable fastener elements in each of said bracket and said locking body for alternatively initiating, maintaining and releasing said compression of at least a portion of said back end of said bracket and at least a portion of the locking body's bearing periphery along said portion of the article handle.

2. The theft-deterring security apparatus of claim 1, in which said locking body includes a second cavity region operably positioned between said front side and said back side, each of said first and second cavity regions originating at said bearing periphery along said back side, and each of said first and second cavity regions having a top side and a bottom side, the bottom side of said first cavity region corresponding to the top side of said second cavity region to form a shared side between said first and second cavity regions, said bearing periphery comprising said top side of said first cavity region, said shared side of said first and second cavity regions and said bottom side of said second cavity region, at least a portion of said bearing periphery contacting said portion of said article handle to compress same upon the exertion and maintenance of compression by said alignable fastener elements.

3. The theft-deterring security apparatus according to claim 1, in which an inside surface of said back end of said bracket is fitted with a compressible friction pad.

4. The theft-deterring security apparatus according to claim 1, in which at least a portion of said bearing periphery of said locking body is fitted with a compressible friction pad.

5. The theft deterring security apparatus according to claim 1, in which said bracket is slidingly adjustable along the length of said article handle, facilitating the variable placement of said theft deterring security apparatus on the handles of multiple, immediately adjacent articles, thus enabling the densely packed display of like constructed security apparatus-equipped articles.

6. The theft-deterring security apparatus according to claim 1, in which said alignable fastener elements include an aperture located on said front end of said bracket, an aperture located on the front side of said first cavity region of said locking body, a threaded screw and a threaded flange nut located immediately adjacent to said front end of said bracket, said screw containing a head with an atypical mechanism for turning and operating said screw, making it substantially difficult for a shopper to defasten and remove said security apparatus from said article.

7. The theft-deterring security apparatus according to claim 1, in which the periphery of said bracket is a single continuous structural ring.

8. The theft-deterring security apparatus according to claim 7, in which said bracket is substantially rectangular in shape to accommodate articles with handles in the shape of rectangular prisms.

9. The theft-deterring security apparatus according to claim 7, in which at least a portion of said bracket is substantially circular in shape to accommodate articles with handles shaped substantially cylindrically.

10. The theft-deterring security apparatus according to claim 7, in which at least a portion of said bracket is substantially hexagonal in shape to accommodate articles with handles in the shape of hexagonal prisms.

11. The theft-deterring security apparatus according to claim 1, in which the periphery of said bracket is discontinuous and comprised of a first portion, a movable second portion, and a hinge operably connecting said first portion and said movable second portion to enable said bracket to be opened, receive the article handle placed therewithin and be closed to substantially surround the article handle so as to fully contain said portion of said handle entirely therewithin, prior to the telescopic receipt of the bracket by said locking body.

12. The theft-deterring security apparatus according to claim 1, in which the periphery of said bracket is discontinuous and comprised of a resilient, spring-loaded material to enable said bracket to be spread apart, receive the article handle placed therewithin and be closed to substantially surround the article handle so as to fully contain said portion of said handle entirely therewithin, prior to the telescopic receipt of the bracket by said locking body.

13. The theft-deterring security apparatus according to claim 11, in which the end of said second movable portion overlaps the end of said first portion, such that said fastening element must be inserted through both the end of the first portion and the end of the movable second portion to compress said locking body about the article handle.

14. The theft-deterring security apparatus according to claim 12, in which the end of a second movable portion overlaps the end of said first portion, such that said fastening element must be inserted through both the end of the first portion and the end of the movable second portion to compress said locking body about the article handle.

15. The theft-deterring security apparatus according to claim 11 in which at least a portion of said bracket is substantially circular in shape to accommodate articles with handles shaped substantially cylindrically.

16. The theft-deterring security apparatus according to claim 11, in which at least a portion of said bracket is substantially hexagonal in shape to accommodate articles with handles in the shape of hexagonal prisms.

17. The theft-deterring security apparatus according to claim 11, in which said bracket is substantially rectangular in shape to accommodate articles with handles in the shape of rectangular prisms.

18. The theft-deterring security apparatus according to claim 12 in which at least a portion of said bracket is substantially circular in shape to accommodate articles with handles shaped substantially cylindrically.

19. The theft-deterring security apparatus according to claim 12, in which at least a portion of said bracket is substantially hexagonal in shape to accommodate articles with handles in the shape of hexagonal prisms.

20. The theft-deterring security apparatus according to claim 12, in which said bracket is substantially rectangular in shape to accommodate articles with handles in the shape of rectangular prisms.

21. The theft-deterring security apparatus of claim 1, in which said alignable fastener elements are substantially difficult for a shopper to defasten and remove said security apparatus from said article once said compression is exerted and maintained by said alignable fastener elements.

22. A theft-deterring security apparatus for restraining articles with elongated rectangular handles, said apparatus comprising:

a rectangular bracket that substantially surrounds the handle of an article so as to contain a portion of said article handle entirely therewithin;

said bracket having a front end and a back end, which back end is fitted with a compressible friction pad, and which front end includes an aperture and flanges for maintaining the position of a threaded flange nut, and between which front and back ends said portion of said article handle is releasably positioned, a locking body having a front side and a back side;

said locking body including a first and second cavity region positioned between said front side and said back side, each of said first and second cavity regions originating at a bearing periphery along said back side, each of said first and second cavity regions having a top side, a bottom side, a left side and a right side, the bottom side of said first cavity region corresponding to the top side of said second cavity region to form a shared side between said first and second cavity regions, said bearing periphery comprising said top side of said first cavity region, said shared side of said first and second cavity regions and said bottom side of said second cavity region, said first cavity region being capable of telescopically receiving at least a portion of said front end of said bracket so as to compress said portion of the elongated article handle between said compressible friction pad on said back end of said bracket and the bearing periphery on said locking body, said front side of said first cavity region of said locking body having an aperture, said aperture being circumscribed by an annular ridge located on said front side of said first cavity region of said locking body, said annular ridge aiding in directing and maintaining the position of the screw within the aperture on said locking body and also aiding in making it substantially difficult for a shopper to defasten and remove said security apparatus from said article, and a threaded screw for inserting through said aperture in said front side of said locking body, inserting through said aperture in said front end of said bracket and threading through said flange nut;

said screw facilitating said locking body's telescopic receipt of said front end of said bracket, said screw containing a head with an atypical mechanism for turning and operating said screw, further making it substantially difficult for a shopper to defasten and remove said security apparatus from said article once said compression is exerted and maintained by alignable fastener elements.

23. A theft-deterring security apparatus according to claim 22, in which at least one of said first and second cavity region contains an electronic surveillance mechanism capable of activating an alarm to signal the potential theft of said article.

24. A theft-deterring security apparatus for restraining articles with knobbed handles, said apparatus comprising:

a first locking body element that surrounds a portion of the knob on the article handle so as to contain a portion of the knob therewithin;

said first locking body element including first cavity portion capable of partially surrounding the knob, a second locking body element that surrounds a portion of the knob on the article handle so as to contain a portion of said knob therewithin;

said second locking body element likewise including a first cavity portion capable of partially surrounding the knob, said first and second locking body elements being capable of aligning and restrainably fastening to one another such that the first cavity portions of both said locking body elements combine to form a knob cavity within which the knob may be surrounded and entirely contained, at least one of said aligned and restrainably fastened first and second locking body elements further forming an anti-theft cavity distinct and isolated from said knob cavity, alignable fastener elements in each of said first and second locking body elements for restrainably maintaining said first and second locking body elements about the knob of said article handle, and one or more theft-deterring elements to hinder the theft of said article.

25. The theft-deterring security apparatus according to claim 24, in which said anti-theft cavity formed by said at least one of said first and second locking body elements contains a theft-deterring element in the form of an electronic surveillance mechanism capable of activating an alarm to signal the potential theft of said article.

26. The theft-deterring security apparatus according to claim 24, in which said anti-theft cavity includes a theft-deterring element in the form of a difficult to remove theft-deterring security apparatus.

27. The theft-deterring security apparatus according to claim 25, in which the electronic surveillance mechanism is an RFID tag.

28. The theft-deterring security apparatus according to claim 27, in which both of said locking body elements further include a second cavity portion, such that when said first and second locking body elements align and restrainably fasten to one another, the second cavity portions of both said locking body elements combine to form the anti-theft cavity.

29. The theft-deterring security apparatus according to claim 24, in which the theft-deterring security apparatus further includes a theft-deterring element in the form of an anchor affixed to a tether wire that extends outside the apparatus, the anchor end of said tether wire being restrainably affixed to the interior of one or more of said locking body elements, the opposite end of the tether wire being affixed to a stationary object within the store to prevent the removal of said article beyond the distance granted by the length of the tether wire.

30. The theft-deterring security apparatus according to claim 24, in which said alignable fastener elements comprise two threaded screws, and a like-threaded region and an aperture on each of said first and second locking body elements, which apertures at least partially obscure the head of each of said threaded screws, each of said threaded screws containing a head with an atypical mechanism for turning and operating said screws, making it substantially difficult for a shopper to defasten and remove said security apparatus from said article.

31. The theft-deterring security apparatus according to claim 24, in which said locking body elements are substantially identical to one another.

32. A theft-deterring security apparatus for restraining articles with knobbed handles, said apparatus comprising:

a first locking body element that surrounds a portion of the knob on the article handle so as to contain a portion of the knob therewithin;

said first locking body element including a first cavity portion capable of partially surrounding the knob and a second cavity portion distinct and isolated from said first cavity portion, a second locking body element that surrounds a portion of the knob on the article handle so as to contain a portion of said knob therewithin;

said second locking body element including a first cavity portion capable of partially surrounding the knob and a second cavity portion distinct and isolated from said first cavity portion, said first and second locking body elements being capable of aligning such that the first cavity portions of both locking body elements combine to form a knob cavity in the shape of a torus, within which the knob may be entirely contained and positioned when the first and second locking body elements are articulated together, and also such that the distinct and isolated second cavity portions combine to form an isolated anti-theft cavity, said isolated anti-theft cavity containing a theft-deterring element; and alignable fastener elements in each of said first and second locking body elements for restrainably maintaining said first and second locking body elements about the knob of said article handle.

33. A theft-deterring security apparatus for restraining articles with elongated handles, said apparatus comprising:

a bracket that substantially surrounds the handle of an article so as to contain a portion of said article handle entirely therewithin;

said bracket having a front end and a back end, between which front and back ends said portion of said article handle is releasably positioned, a locking body having a front side and a back side;

said locking body including a first cavity region positioned between said front side and said back side, said first cavity region originating at a bearing periphery along said back side, said locking body capable of telescopically receiving at least a portion of said bracket's front end within said first cavity region so as to compress said portion of the article handle between at least a portion of said back end of said bracket and at least a portion of the bearing periphery of said locking body, alignable fastener elements in each of said bracket and said locking body for exerting and reieasably maintaining said compression of at least a portion of said back end of said bracket and at least a portion of the locking body's bearing periphery along said portion of the article handle, said locking body including a second cavity region operably positioned between said front side and said back side, each of said first and second cavity regions originating at said bearing periphery along said back side, and each of said first and second cavity regions having a top side and a bottom side, the bottom side of said first cavity region corresponding to the top side of said second cavity region to form a shared side between said first and second cavity regions, said bearing periphery comprising said top side of said first cavity region, said shared side of said first and second cavity regions and said bottom side of said second cavity region, at least a portion of said bearing periphery contacting said portion of said article handle to compress same upon the exertion and maintenance of compression by said alignable fastener elements.

34. The theft-deterring security apparatus according to claim 33, in which the second cavity region of the locking body contains an electronic surveillance mechanism capable of activating an alarm to signal the potential theft of said article.

35. The theft-deterring security apparatus according to claim 34, in which the electronic surveillance mechanism is an RFID tag.

36. The theft-deterring security apparatus according to claim 34, in which the second cavity region of the locking body extends farther beyond the first cavity region to enable the placement of an electronic surveillance mechanism farther away from the article handle to avoid any disruption of the electronic surveillance mechanism caused by metal contained within article handles.

37. A theft-deterring security apparatus for restraining articles with elongated handles, said apparatus comprising:

a bracket that substantially surrounds the handle of an article so as to contain a portion of said article handle entirely therewithin;

said bracket having a front end and a back end, between which front and back ends said portion of said article handle is releasably positioned, a locking body having a front side and a back side;

said locking body including a first cavity region positioned between said front side and said back side, said first cavity region originating at a bearing periphery along said back side, said locking body capable of telescopically receiving at least a portion of said bracket's front end within said first cavity region so as to compress said portion of the article handle between at least a portion of said back end of said bracket and at least a portion of the bearing periphery of said locking body, and alignable fastener elements in each of said bracket and said locking body for exerting and releasably maintaining said compression of at least a portion of said back end of said bracket and at least a portion of the locking body's bearing periphery along said portion of the article handle, said alignable fastener elements including an aperture located on said front end of said bracket, an aperture located on the front side of said first cavity region of said locking body, a threaded screw and a threaded flange nut located immediately adjacent to said front end of said bracket, said screw containing a head with an atypical mechanism for turning and operating said screw, making it substantially difficult for a shopper to defasten and remove said security apparatus from said article.

38. The theft-deterring security apparatus according to claim 37, in which said alignable fastener elements further include an annular ridge circumscribing the aperture located on said front side of said first cavity region of said locking body, said annular ridge aiding in directing and maintaining the position of the screw within the aperture on said locking body and said annular ridge also partially obscuring the head of said screw, thereby aiding in making it substantially difficult for a shopper to defasten and remove said security apparatus from said article.

39. The theft-deterring security apparatus according to claim 37, in which said bracket includes flanges for maintaining the position of the flange nut.

40. The theft-deterring security apparatus according to claim 37, in which the threaded screw, the threaded flange nut, the aperture of said bracket and the aperture of said first cavity region of said locking body are sized to ensure that the screw avoids physical contact with said article handle upon compression exerted by said alignable fastener elements.

41. A theft-deterring security apparatus for restraining articles with knobbed handles, said apparatus comprising:

a first locking body element that surrounds a portion of the knob on the article handle so as to contain a portion of the knob therewithin;

said first locking body element including a first cavity portion capable of partially surrounding the knob, a second locking body element that surrounds a portion of the knob on the article handle so as to contain a portion of said knob therewithin;

said second locking body element likewise including a first cavity portion capable of partially surrounding the knob, said first and second locking body elements being capable of aligning and restrainably fastening to one another such that the first cavity portions of both said locking body elements combine to form a knob cavity within which the knob may be surrounded and entirely contained, alignable fastener elements in each of said first and second locking body elements for restrainably maintaining said first and second locking body elements about the knob of said article handle, and one or more theft-deterring elements to hinder the theft of said article, at least one of said one or more theft-deterring elements comprising an anchor affixed to a tether wire that extends outside the apparatus, the anchor end of said tether wire being restrainably affixed to the interior of one or more of said locking body elements forming said knob cavity, the opposite end of the tether wire being affixed to a stationary object within the store to prevent the removal of said article beyond the distance granted by the length of the tether wire.

42. The theft-deterring security apparatus according to claim 41, in which the tether wire contains two electric-conducting wires that enable an alarm system, whereby the severing of the tether wire triggers an alarm to signal the potential theft of said article.

* * * * *